US005100142A

United States Patent [19]

Cannata

[11] Patent Number: 5,100,142

[45] Date of Patent: Mar. 31, 1992

[54] PUZZLE HAVING SIMULTANEOUSLY ROTATING GEARED ELEMENTS

[76] Inventor: Antonio Cannata, 14 Patience Cres., London, Ontario, Canada, N6E 2K9

[21] Appl. No.: 667,639

[22] Filed: Mar. 11, 1991

[30] Foreign Application Priority Data

Jun. 29, 1990 [CA] Canada ..... 2020225

[51] Int. Cl.[5] ..... A63F 9/08

[52] U.S. Cl. ..... 273/155; 273/153 S; 446/103; 434/401

[58] Field of Search ..... 273/153 R, 153 S, 155; 446/103; 434/401, 402, 404, 407

[56] References Cited

U.S. PATENT DOCUMENTS

| | | | |
|---|---|---|---|
| 2,095,046 | 1/1937 | Wilner | 273/153 R |
| 2,545,131 | 3/1951 | Ayres | 434/401 |
| 2,618,868 | 11/1952 | Medlock | 434/206 |
| 2,692,443 | 10/1954 | Milligan | 434/401 |
| 3,133,358 | 5/1964 | Schramm | 434/198 |
| 3,134,593 | 5/1964 | Monigal | 446/103 X |
| 3,172,666 | 3/1965 | Ryan | 434/401 X |
| 3,193,293 | 7/1965 | Schaper | 446/103 X |
| 3,417,996 | 12/1968 | Janiszewski | 434/401 X |
| 4,218,609 | 8/1980 | Chin | 434/401 X |
| 4,468,033 | 8/1984 | Minami et al. | 273/153 |
| 4,589,663 | 5/1986 | Doroslovac | 273/155 |
| 4,784,387 | 11/1988 | Liversidge | 446/103 X |
| 4,869,506 | 9/1989 | Wiggs et al. | 273/155 |

FOREIGN PATENT DOCUMENTS

| | | | |
|---|---|---|---|
| 928734 | 6/1973 | Canada | 273/142 |
| 1199351 | 1/1986 | Canada | 272/40 |
| 2566281 | 12/1985 | France | 273/155 |

*Primary Examiner*—William H. Grieb
*Assistant Examiner*—William M. Pierce

[57] ABSTRACT

The present invention is directed to a puzzle having nine virtually identical interconnected members contained within a casing. The members are interconnected through toothed gears which are accessible from the exterior of the casing. Each of the nine members and the top surface of the casing has colored dots arranged in an array. To solve the puzzle matching pairs of dots must be aligned with each other and with the dots arranged around the periphery of the surface of the puzzle. The puzzle is both challenging and entertaining and will provide the user with hours of entertainment.

3 Claims, 3 Drawing Sheets

PUZZLE HAVING SIMULTANEOUSLY ROTATING GEARED ELEMENTS

The present invention is directed to a puzzle whereby a plurality of members each including a number of indicia arranged in an array and visible from the exterior of the puzzle must be rearranged so as to align in matching pairs to solve the puzzle. The members are interconnected such that when one is rotated the others are caused to rotate simultaneously.

BACKGROUND OF THE INVENTION

Various types of games and puzzles of this type are known. Most famous is probably the Rubik's Cube wherein the object of the game is to arrange a set of surfaces into a predetermined sequence and wherein movement of one surface concurrently moves at least another surface. This concurrent movement of the other surface introduces an element of complexity that is challenging and gives the game considerable play and entertainment value.

U.S. Pat. No. 4,468,033 describes a similar sort of puzzle. The puzzle disclosed in that patent has a housing and a plurality of members rotatably mounted on the housing such that they are operative in association with one another. When one member is rotated the other members rotate simultaneously. Each member has a plurality of object repositories located thereon. A plurality of objects, at least one less than the number of object repositories, are positioned within the object repositories. As the members move the objects are carried on the object repositories and can be moved from one repository to another.

U.S. Pat. No. 4,869,506 is directed to a mechanical puzzle comprising a casing having solid gears and pairs of split gears rotatably supported with their faces visible from opposed faces of the casing and selector gears each journalled in the casing and axially movable between upper and lower positions to selectively connect the solid gear to adjacent upper and lower split gears. In one embodiment the exposed faces of the gears have a clock face located thereon. One object is to align the hands on each clock face to indicate the same time. Again rotating one gear causes others to rotate.

OBJECT OF THE INVENTION

An object of the present invention is to provide a type of puzzle or game of skill that challenges and entertains the mind. Further, the puzzle is lightweight, economical to manufacture and durable. It will provide many hours of enjoyment and entertainment.

SUMMARY OF THE INVENTION

In a preferred embodiment there is provided a puzzle comprising a casing having a transparent upper wall; a plurality of members each rotatably mounted in said casing, said members comprising an upper spool and a lower spool coupled concentrically such that said lower spool can rotate independently of said upper spool; each of said members also comprising intermeshing means which allow each of said members to contact adjacent member and being positioned such that rotation of one of said members is communicated to the remainder of said members such that all of said members rotate in association with one another; each of said members including a like number of indicia located thereon in an array around the periphery of said members; a plurality of indicia associated with each of said members located about the periphery of the upper wall of the casing at spaced intervals; and a means to lock any one of the upper spools in a fixed position while allowing the rotation of the associated lower spool.

DESCRIPTION OF THE DRAWINGS

In drawings which illustrate preferred embodiments of the present invention.

DETAILED DESCRIPTION OF THE INVENTION

Figure 1:
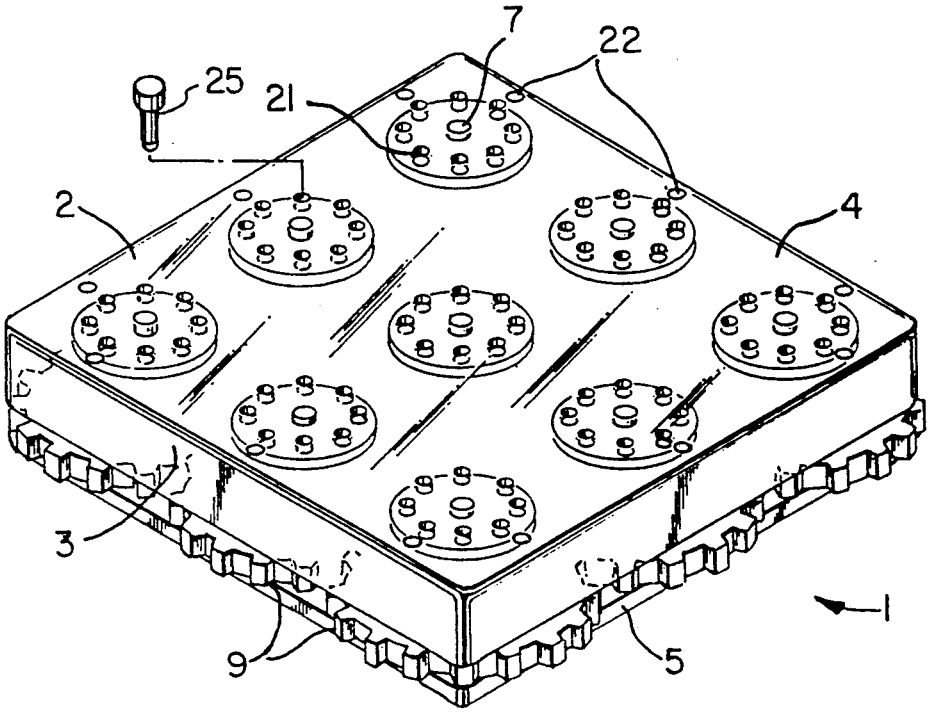
FIG. 1 is a perspective view of the present invention.
Figure 2:
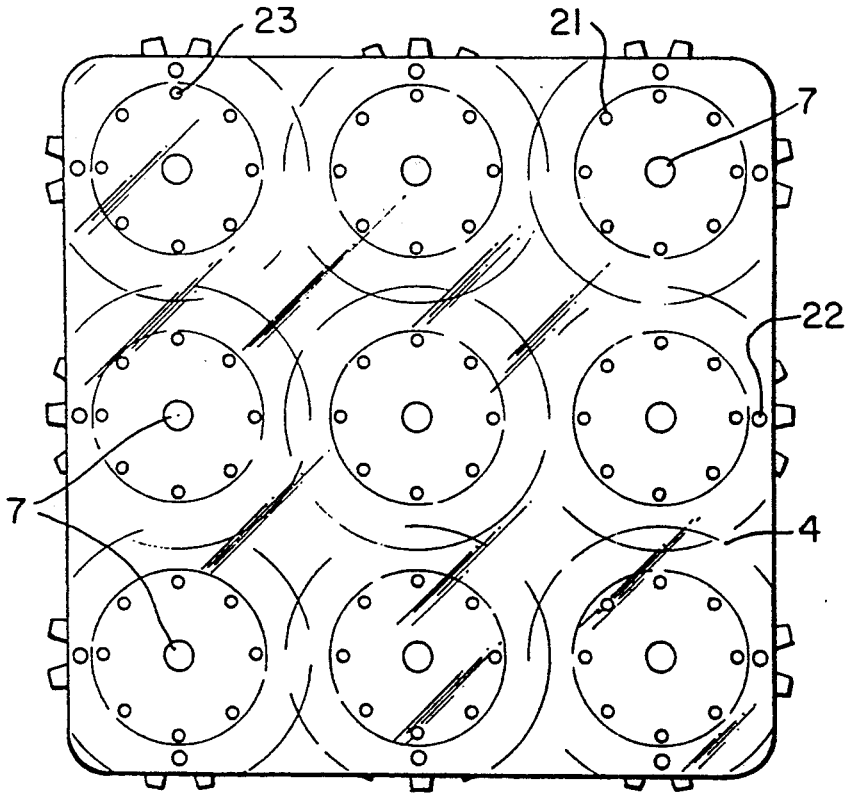
FIG. 2 is a top plan view.
Figure 3:
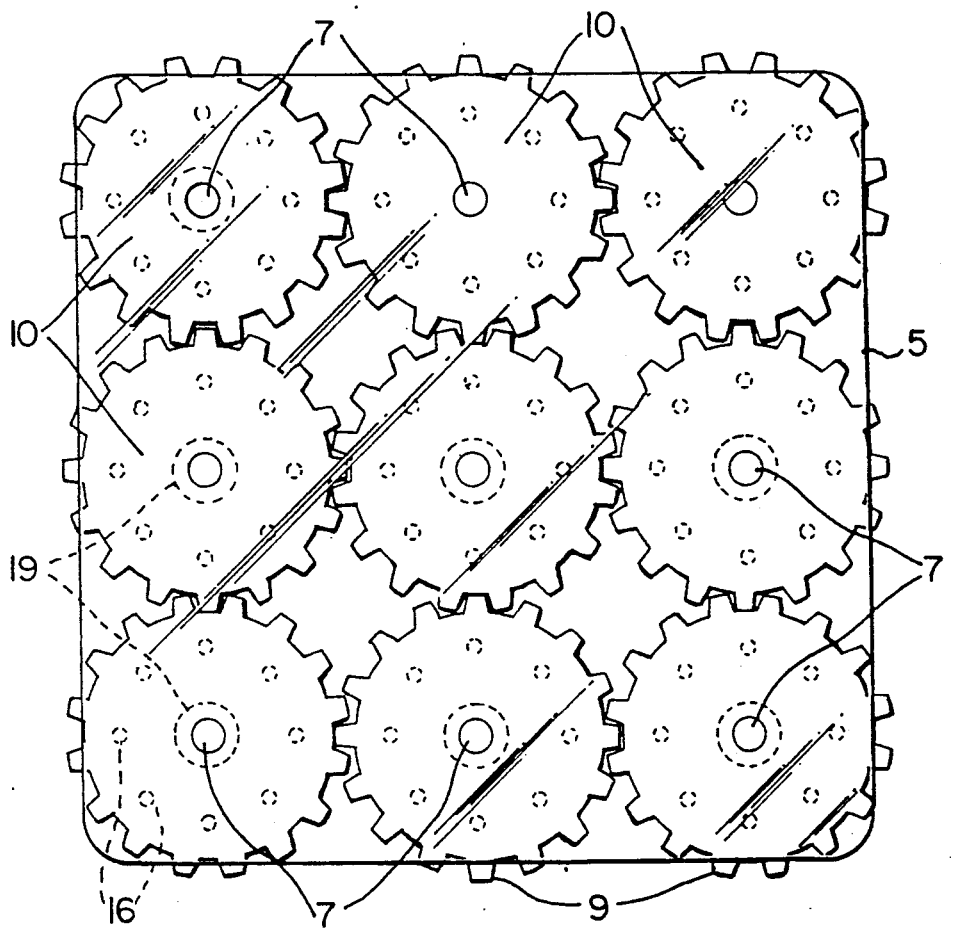
FIG. 3 is a bottom plan view.
Figure 4:
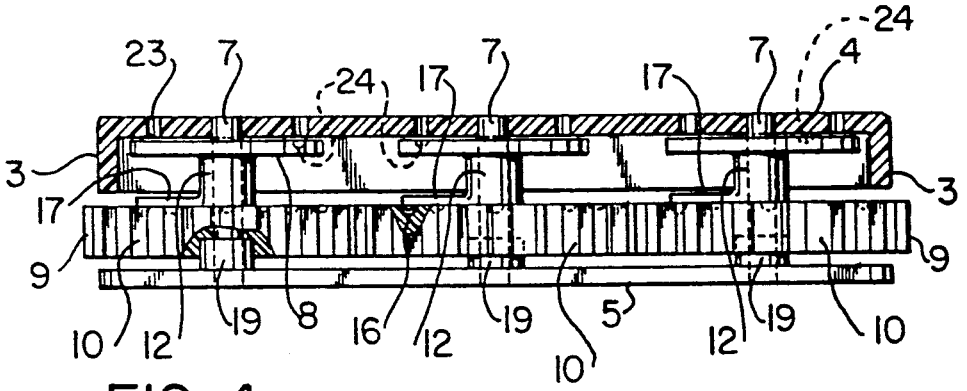
FIG. 4 is a side view (outer panel removed to show internal structure)
Figure 5:
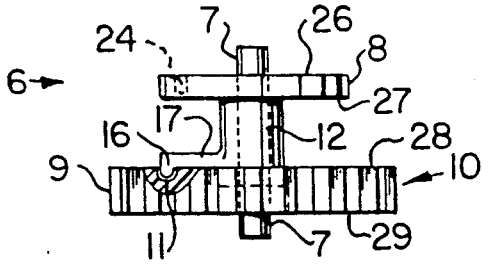
FIG. 5 is a side view of one of the members.
Figure 6:
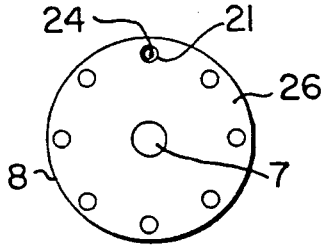
FIG. 6 is a plan view of the top surface of the upper spool.
Figure 7:
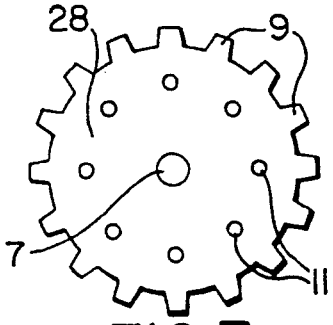
FIG. 7 is a plan view of the top surface of the lower spool.

In the drawings like numerals refer to like parts.

Referring to FIG. 1 the puzzle of the present invention is generally indicated by the numeral 1. The puzzle comprises a casing 2 having four side walls 3, a transparent top wall 4 and a bottom wall 5. Inside the casing 2 are nine virtually identical members 6.

Each member 6 comprises a post 7, an upper spool 8, a lower spool 10. Upper spool 8 has a top surface 26, a bottom surface 27 and a cylindrical portion 12 extending from the bottom surface 27 towards the lower spool 10 and encasing the post 7. Lower spool 10 has a top surface 28 and bottom surface 29. Lower spool 10 has a toothed outer periphery surface 9. Lower spool 10 has eight concave indentations 11 in its top surface 28. A spring arm 17 is attached to the cylindrical portion 12 of upper spool 8. Spring arm 17 has a small protuberance 16 situated at its end. Upper spool 8 and lower spool 10 are biased together in contact with each other by flanges 19 on bottom wall 5. Each flange 19 is formed integral with bottom wall 5 and has a hole to receive post 7. Post 7 is held in place by flange 19 and does not rotate. Post 7 is further held in place by embedding it into top wall 4.

The arrangement of the eight concave indentations 11 and the spring arm 17 creates a type of slip mechanism to allow lower spool 10 to rotate independently of upper spool 8.

Attached to the top surface 26 of upper spool 8 are eight coloured dots 21. The dots 21 are visible through transparent top wall 4 of casing 2. The dots 21 are of four different colours and are arranged in a random order around the periphery of top surface 26 on each of the nine members 6. There are also twelve coloured dots 22 arranged around the periphery of the transparent top wall 4. There are three coloured dots 22 arranged at spaced intervals on each of the four edges of top wall 4. They are positioned so as to align with the centre of the top surface 26 and with one of the eight dots 21 positioned on the top surface 26 of the nine members 6.

Transparent top wall 4 has seventy-two tiny holes 23 located therein positioned over each of the coloured dots 21 of the nine members 6. Each top surface 26 of each upper spool 8 has one hole 24 located therein. This hole 24 is positioned in one of the coloured dots 21. The seventy-two tiny holes 23 are positioned over each of the nine members 6 and each member 6 has a hole 24 located therein.

Each outer toothed periphery surface 9 on lower spool 10 meshes with the outer toothed periphery surface 9 on adjacent member 6 such that when one lower spool 10 is rotated it causes the other lower spools 10 to rotate simultaneously. The outer toothed periphery surfaces 9 extend outside the side walls 3 of the casing 2 such that they can be accessed and rotated by the fingers of the person playing with the puzzle.

Figure 8:
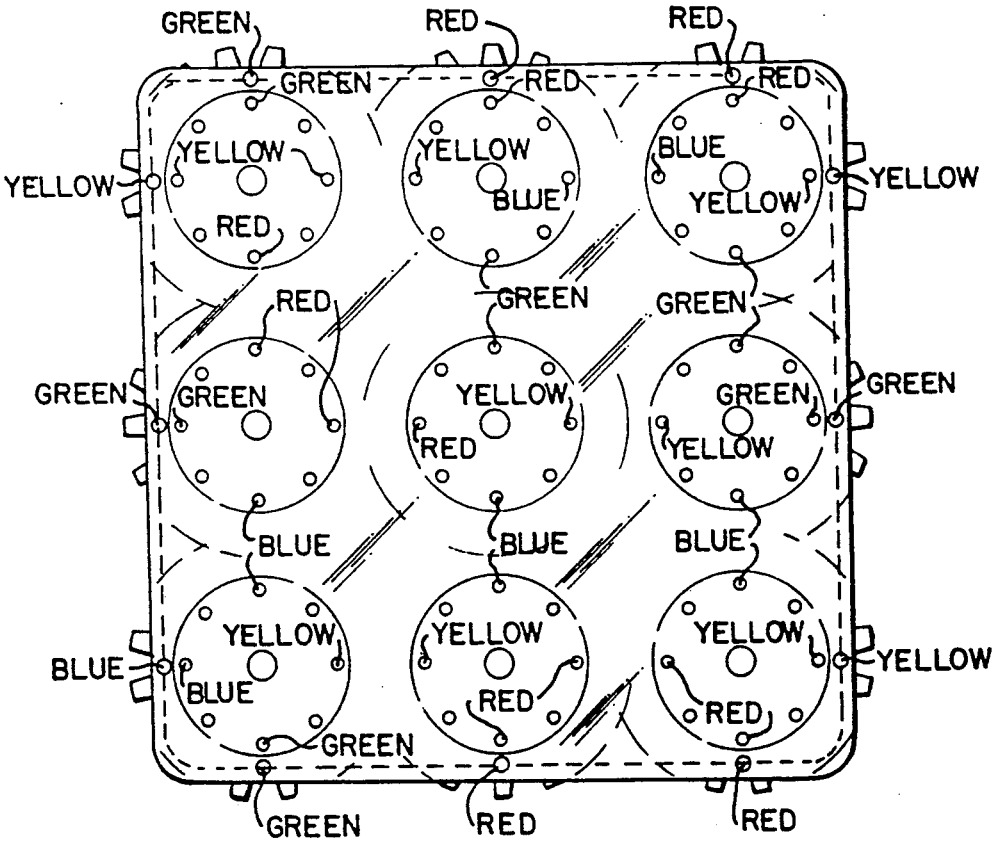
FIG. 8 is a top plan view of the solved puzzle.

To solve the puzzle the user must align same coloured pairs of dots in all directions. That is, the dots 22 along the outside edge of the transparent top wall 4 must align with the same coloured dots 21 on the top surfaces 26 of the nine members 6 and the dots 21 on the top surfaces 26 must align with the same coloured dots 21 on each of the nine members 6. FIG. 8 shows the puzzle in its solved form.

The puzzle is provided with one pin 25 which fits through one of the seventy-two holes 23 and into one of the nine holes 24.

The puzzle is solved by aligning one of the members 6 in a desired position and then inserting the pin 25 into the holes 23 and 24 so as to lock that member 6 in place. The outer toothed periphery surfaces 9 are then rotated further to align the other members 6 in the appropriate manner. Only one pin 25 is provided and the difficulty arises in that as one gear is turned to rotate that member 6 the other members 6 with the exception of the locked one, also rotate.

Insertion on pin 25 into holes 23 and 24 of one of the nine members 6 locks upper spool 8 of that particular member 6 in place such that upper spool 8 cannot rotate. Yet lower spool 10 can be caused to rotate through the slip mechanism formed by the arrangement of upper spool 8, lower spool 10, spring arm 17, concave indentations 11 and protuberance 16 at the end of spring arm 17. That is, protuberance 16 rests in one of the eight concave indentations 11 when the members 6 are not rotating or are rotating freely when pin 25 is not in place. When upper spool 8 is locked in place, in order to rotate lower spool 10 and thus the remaining eight members 6, protuberance 16 must jump out of one indentation 11 and snap into the next indentation 11 on lower spool 10. This allows for measured movement of lower spool 10 and the remaining eight members 6. This rotation is continued until the coloured dots 21 are appropriately arranged to solve the puzzle.

I claim:

1. A puzzle comprising a casing having a transparent upper wall; a plurality of members each rotatably mounted in said casing, said members comprising an upper spool and a lower spool coupled concentrically such that said lower spool can rotate independently of said upper spool; each of said members also comprising intermeshing means which allow each of said members to contact adjacent members and being positioned such that rotation of one of said members is communicated to the remainder of said members such that all of said members rotate in association with one another; each of said members including a like number of indicia located thereon in an array around the periphery of said members; a plurality of indicia associated with each of said members located about the periphery of the upper wall of the casing at spaced intervals; and a means to lock any one of the upper spools in a fixed position while allowing rotation of its associated lower spool.

2. The puzzle according to claim 1 wherein said plurality of members are arranged in three rows of three members each.

3. The puzzle according to claim 1 wherein said lower spool has a top surface having eight concave indentations arranged in a circle around the top surface and said upper spool has a spring arm having a protuberance at one end adapted to engage one of the eight concave indentations on the lower spool.

* * * * *